US005372180A

United States Patent [19]

Grocock et al.

[11] Patent Number: 5,372,180

[45] Date of Patent: Dec. 13, 1994

[54] TWIN ROLL CASTING

[75] Inventors: Peter G. Grocock; Philip M. Thomas, both of Dorset, England

[73] Assignee: Davy McKee (Poole) Limited, Dorset, England

[21] Appl. No.: 971,761

[22] PCT Filed: Aug. 2, 1991

[86] PCT No.: PCT/GB91/01324

§ 371 Date: Mar. 2, 1993

§ 102(e) Date: Mar. 2, 1993

[87] PCT Pub. No.: WO92/02321

PCT Pub. Date: Feb. 20, 1992

[30] Foreign Application Priority Data

Aug. 3, 1990 [GB] United Kingdom ..... 9017040
Aug. 3, 1990 [GB] United Kingdom ..... 9017041

[51] Int. Cl.[5] ..... B22D 11/16; B22D 11/06

[52] U.S. Cl. ..... 164/452; 164/480

[58] Field of Search ..... 164/452, 428, 480, 154, 164/454, 413

[56] References Cited

U.S. PATENT DOCUMENTS

| | | | |
|---|---|---|---|
| 4,054,173 | 10/1977 | Hickam | 164/428 |
| 4,565,240 | 1/1986 | Shibuya et al. | 164/452 |
| 4,727,927 | 3/1988 | Popik | 164/452 |
| 4,735,254 | 4/1988 | Itoyama et al. | 164/452 |

FOREIGN PATENT DOCUMENTS

| | | | |
|---|---|---|---|
| 60-83746 | 5/1985 | Japan | 164/428 |
| 60-83747 | 5/1985 | Japan | 164/428 |
| 63-49347 | 4/1988 | Japan | 164/428 |

*Primary Examiner*—P. Austin Bradley
*Assistant Examiner*—Erik R. Puknys
*Attorney, Agent, or Firm*—Lee, Mann, Smith et al.

[57] ABSTRACT

In a twin roll caster, the problem of the casting sticking to one or other of the rolls can be overcome or at least reduced by adjusting the relative speed of rotation of the rolls when sticking is detected or anticipated.

6 Claims, 2 Drawing Sheets

TWIN ROLL CASTING

Figure 1:
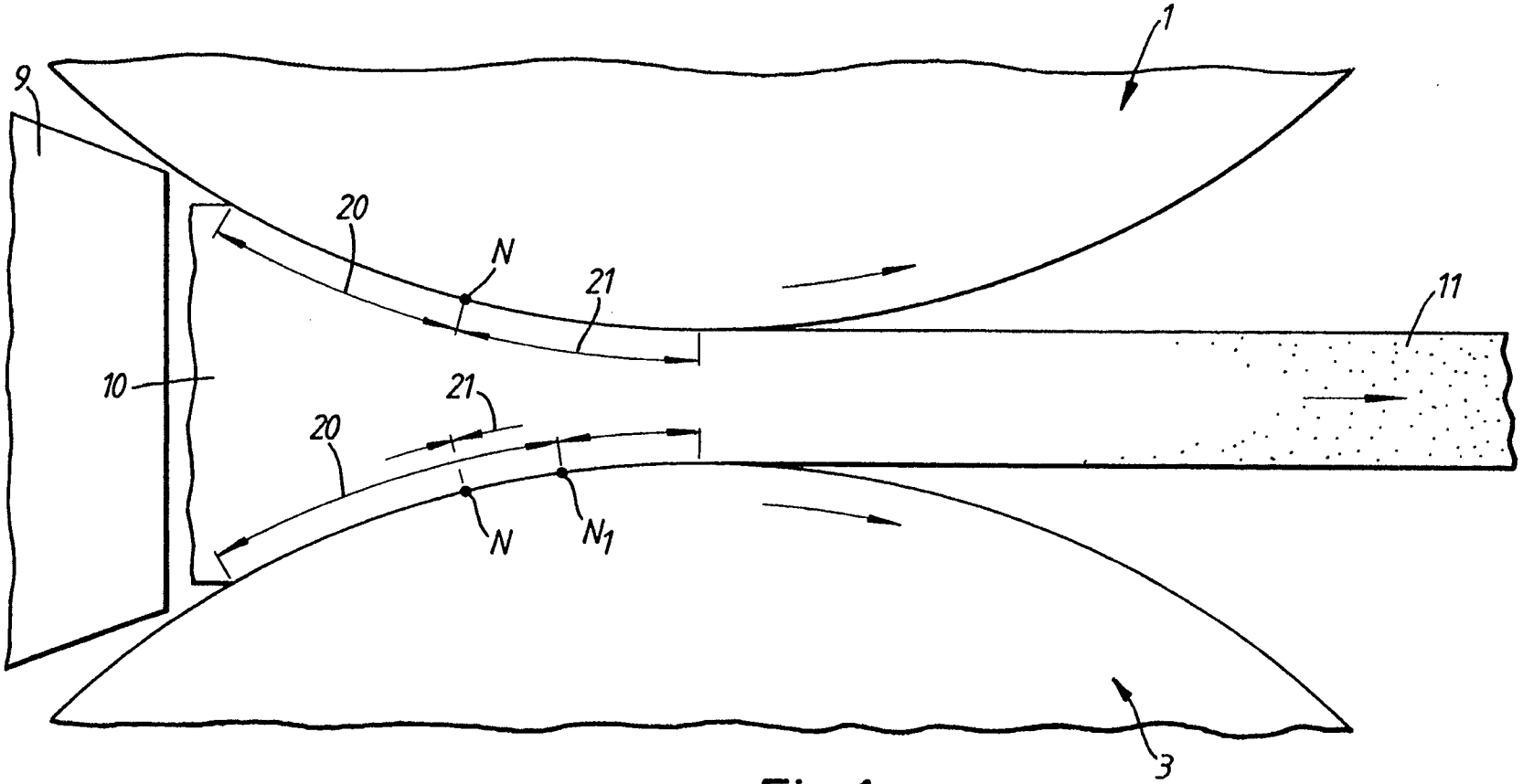

This invention relates to the casting of metal, particularly light metal alloys, by the twin roll casting process.

In this known process, liquid metal is introduced into the bite between two cooled rotating rolls. Where the liquid metal comes into contact with the rolls, a skin is formed and this skin, which rapidly thickens, undergoes hot working before finally emerging from between the two rolls in the form of a strip. During the hot working of the material, the cast material initially is extruded towards the liquid metal feed because the strip is moving more slowly than the surface of the adjacent rolls. Where the strip is extruded from the roll bite, it leaves the machine at a greater velocity than the peripheral surface of the adjacent rolls and this is known as "forward extrusion". There is a neutral point between the entry side of the molten metal and the exit side of the strip where the movement of the strip is equal to the peripheral speed of the adjacent rolls. It is usual for both of the rolls, which are of the same diameter, to be driven from a common source and thus both roll surfaces have the same peripheral speed. In these circumstances the neutral point is in the same position for each of the two rolls.

One of the problems encountered in twin roll casting is sticking of the casting to one or other of the rolls. In general, sticking becomes a greater problem as the thickness of the workpiece being cast is reduced. When casting workpieces of a thickness of, say, less than 2.5 mm, sticking of the casting to one or other of the rolls can become very critical.

An object of the present invention is to provide a twin roll caster having provision for reducing or eliminating sticking of the workpiece.

According to a first aspect of the present invention, in a method of operating a twin roll caster, each roll is driven by independent drive means, either with both rolls rotated at a predetermined speed or with one roll rotated at a predetermined speed and a predetermined torque ratio between the rolls; molten metal is introduced into the gap between the rolls to produce a casting; and characterised in that, at least when sticking of the casting to either of the rolls is detected or is anticipated, the relative speed of the two rolls is adjusted in a manner to reduce the sticking of the workpiece to the roll.

The amount of sticking is dependent on the amount of deformation the material undergoes after solidification is complete (usually referred to as forward slip or extrusion) and this, in turn, is dependent on the material properties and the operating conditions. Casting conditions that result in low values of forward slip encourage sticking. Typically these will include too high a casting speed, too high a casting temperature, too small a tip set back or too little casting tension. By measuring operating parameters, such as, casting temperature, roll temperature, roll coolant temperature or the like, it is sometimes possible to anticipate that sticking is likely to occur. If one or more of the operating parameters start to move outside of an acceptable band of values, sticking of the casting to one of the rolls is likely to occur.

When sticking of the workpiece to one of the rolls is detected, the torque of that roll decreases and, consequently, the power taken by the motor which drives that roll is suddenly decreased and the decrease in power can be detected and used to indicate the onset of sticking. The speed of rotation of the other roll is then decreased and this un-sticks the cast workpiece from the first-mentioned roll.

The speed of rotation of each roll may be modulated about its predetermined speed at substantially 180° out of phase with the other roll. The frequency of modulation may be in the range 0.2 to 2 HZ and the amplitude of modulation may be up to 30% of the predetermined speed. The rolls may be modulated continuously or they may be modulated only when sticking is detected or when sticking is anticipated.

According to a second aspect of the invention, a twin roll caster comprises a pair of fluid cooled rolls; independent drive means for rotating each roll; means for adjusting the gap between the rolls; and means for introducing molten metal into the gap; characterised in the provision of means for adjusting the relative speed of the two rolls.

Figure 2:
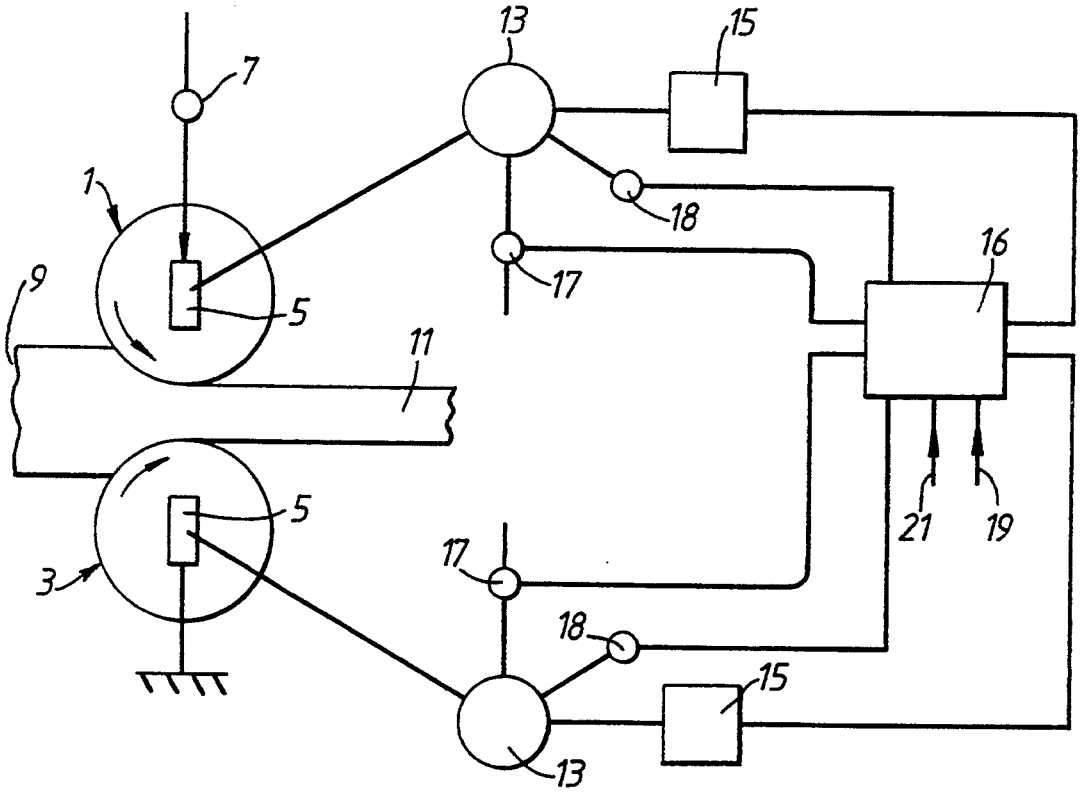

In order that the invention may be more readily understood, it will now be described, by way of example only, with reference to the accompanying drawings, in which:

FIG. 1 illustrates the theory of operation of the caster in accordance with the present invention; and FIG. 2 is a schematic diagram of a twin roll caster in accordance with the present invention.

Referring now to FIG. 1, the rolls 1, 3 are indicated with a workpiece 11 being cast between them. Molten metal 10 from the nozzle 9 is introduced into one side of the roll gap and the solidified cast strip 11 issues from the opposite side of the roll gap. Assuming that the two rolls have the same diameter and are driven at the same speed, then, over a region indicated by reference numeral 20, the strip being formed moves slower than the peripheral speed of the adjacent roll and, consequently, there is backward extrusion on the cast strip. With respect to each roll, the strip is extruded from the roll bite at a greater velocity than the peripheral speed of the adjacent roll and, over this region indicated by reference numeral 21, forward extrusion takes place. For each roll there is a point N, referred to as the "neutral" point where the speed of the strip material is the same as the peripheral speed of the adjacent roll. In the conditions specified, the neutral position for roll 1 is vertically above the neutral position for roll 3. At the neutral position N, between the strip and the top roll, sticking may occur and the top surface of the strip is drawn towards the peripheral surface of the roll as it leaves the roll gap.

If now the speed of rotation of roll 3 is increased with respect to the speed of rotation of roll 1, the neutral point for roll 3 moves forward to a position $N_1$ which is closer to the position on the roll bite from which the workpiece issues. This means that the forward extrusion on the workpiece is reduced and the backward extrusion is increased. The forward strip extrusion has a major influence on the sticking characteristics. Effectively, the forward extrusion causes the strip to slide relative to the roll surface which prevents it from sticking provided the shear strength of the strip is greater than the friction force between the strip and the roll. This has the effect of disconnecting the strip from the upper roll.

Referring to FIG. 2, a twin roll caster for casting thin metal strip, such as aluminium strip, comprises a pair of cooled rolls 1, 3. Each roll is rotatably suppported at its ends in bearing chock assemblies, indicated by reference numeral 5. Conventional means (not shown) are provided for adjusting the gap between the two rolls. A detecting device 7 may be associated with the bearing chock assemblies of one of the rolls to determine the load tending to separate the rolls when the caster is in use. A nozzle 9 delivers molten metal to one side of the pair of rolls and the metal, on contacting the cooled rolls, immediately forms a skin and the casting in the form of a metal strip 11 issues from the gap between the rolls.

The two rolls are driven by separate motors 13, which may be electric motors or hydraulic motors, and each motor is controlled by a controller 15. The controllers are controlled, in turn, by a processor 16. Each motor 13 has a detecting device 17 associated with it for detecting the torque supplied to the motor and the detecting means 17 of each motor supplies an electrical signal to the processor 16. The speed of each motor is measured by a detector 18 and the speed signals are supplied to the processor.

In use, the two motors are controlled by their respective controllers 15 to rotate the rolls 1, 3, either at the same predetermined speed or one of the rolls is rotated at a predetermined speed with a predetermined torque ratio between the rolls. Molten metal is introduced through the nozzle 9 into the gap between the rolls to form a thin strip casting 11. If the casting tends to stick to either of the rolls, say, roll 1, the torque taken by the motor 13 driving that roll immediately decreases and this is detected by the detector 17. This signal is supplied to the processor 16 and it is arranged to cause the other motor to decrease the speed of rotation of the roll 3. This has the effect of un-sticking the workpiece from the roll 1. In a similar way, if the cast workpiece 11 tends to stick to the roll 3, this is detected and the speed of roll 1 is decreased. There is a tendency for the separating force to increase when sticking occurs but this is detected by the detector 7 which arranges for a servo-controlled gap regulating mechanism to adjust the roll gap accordingly.

In an alternative method of operating the twin roll caster, the two motors are controlled by their respective controllers 15, in response to a datum signal provided at the processor on line 19, to rotate the rolls 1, 3 at the same predetermined peripheral speed. In addition, a periodic modulation signal is supplied to the processor on line 21. This modulation signal causes the speed of rotation of each motor to be modulated in a periodic manner about the predetermined speed. The amplitude of the modulation is up to 30% of the predetermined speed and the frequency of modulation is within the range 0.2 to 2 HZ. The modulation applied to one of the motors is substantially 180° out of phase with the modulation applied to the other motor.

This speed modulation of each roll causes the conditions which encourage sticking of the cast workpiece to the roll to be cyclically favourable and un-favourable compared with steady conditions. Under these conditions, sticking to either roll is unable to develop to the same extent as occurs when speed modulation of the rolls is not present.

We claim:

1. A method of operating a caster having two rolls with a gap therebetween, comprising the steps of driving one of the rolls by a first drive motor at a predetermined speed under the control of a first controller;

driving the other roll by a second drive motor at a predetermined speed under the control of a second controller;

introducing molten metal into the gap between the rolls to produce a casting; and causing the controllers associated with the drive motors to adjust the speed of rotation of the rolls so that the speed of rotation each roll is modulated about its predetermined speed at substantially 180° out of phase with the other roll.

2. A method as claimed in claim 1, in which the frequency of modulation is in the range 0.2 to 2.0 HZ and the amplitude of modulation is up to 30% of the predetermined speed.

3. A method of operating a caster having two rolls with a gap therebetween, comprising the steps of driving one of the rolls by a first drive motor under the control of a first controller at a predetermined speed and obtaining a signal representing the torque supplied by the first drive motor;

driving the other roll by a second drive motor under the control of a second controller at said predetermined speed or with a predetermined torque ratio between the rolls and obtaining a signal representing the torque supplied by the second drive motor;

introducing molten metal into the gap between the rolls to produce a casting;

comparing said torque signals and, if sticking of the casting to either of the rolls is detected, causing the controllers associated with the drive motors to adjust the speed of rotation of the rolls so that the speed of rotation of each roll is modulated about its predetermined speed at substantially 180° out of phase with the other roll.

4. A method as claimed in claim 3, in which the frequency of modulation is in the range of 0.2 to 2.0 HZ and the amplitude of modulation is up to 30% of the predetermined speed.

5. A method of operating a caster having two rolls with a gap therebetween, comprising the steps of driving one of the rolls by a first drive motor at a predetermined speed;

driving the other roll by a second drive motor at said predetermined speed or with a predetermined torque ratio between the rolls;

measuring an operating parameter of the caster, comparing said measured parameter with a predetermined value of said parameter and, in the event of significant difference between said measured parameter and said predetermined value being detected, causing the drive motors to adjust the speed of rotation of the rolls so that the speed of rotation of each roll is modulated about its predetermined speed at substantially 180° out of phase with the other roll.

6. A method of operating a caster having two rolls with a gap therebetween, comprising the steps of driving one of the rolls by a first drive motor under the control of a first controller at a predetermined speed and obtaining a signal representing the torque supplied by the first drive motor;

driving the other roll by a second drive motor under the control of a second controller at said predetermined speed or with a predetermined torque ratio between the rolls and obtaining a signal representing the torque supplied by the second drive motor;

introducing molten metal into the gap between the rolls to produce a casting;

comparing said torque signals and, if sticking of the casting to one of the rolls is detected, causing the controller associated with the roll to which the casting is not sticking to decrease the speed of rotation of that roll, and causing the controller associated with the roll to which the casting is sticking to increase the speed of rotation of that roll.

* * * * *